US006883889B2

(12) United States Patent
Mackenzie et al.

(10) Patent No.: US 6,883,889 B2
(45) Date of Patent: Apr. 26, 2005

(54) FLUID EJECTION DEVICE

(75) Inventors: Mark H. Mackenzie, Corvallis, OR (US); Joseph M. Torgerson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 74 days.

(21) Appl. No.: 10/427,481

(22) Filed: Apr. 30, 2003

(65) Prior Publication Data

US 2004/0217997 A1 Nov. 4, 2004

(51) Int. Cl.[7] ..... B41J 29/38
(52) U.S. Cl. ..... 347/12
(58) Field of Search ..... 347/12, 9, 20, 347/5, 40, 41, 47; 216/4, 27; 29/890.1, 592; 430/311

(56) References Cited

U.S. PATENT DOCUMENTS 6,527,370 B1 * 3/2003 Courian et al. ..... 347/47

* cited by examiner

*Primary Examiner*—Raquel Yvette Gordon

(57) ABSTRACT

In one embodiment, the present invention recites a fluid ejection device comprising a first drop ejector configured to cause fluid having a first drop weight to be ejected from the firing chamber, and includes a first heating element. A first bore, disposed within an orifice layer proximate to the first drop ejector, is associated with the first drop ejector. A second drop ejector is configured to cause fluid having a second drop weight to be ejected from the firing chamber, and includes a second heating element A second bore, disposed within the orifice layer proximate to the second drop ejector, is associated with the second drop ejector. A voltage source, coupled in series with the first drop ejector and the second drop ejector, is configured to generate a first voltage for activating the first drop ejector individually and a second voltage for activating the first drop ejector and the second drop ejector substantially concurrently.

46 Claims, 13 Drawing Sheets

FLUID EJECTION DEVICE

TECHNICAL FIELD

The present claimed invention relates to fluid ejection devices. More specifically, the present claimed invention relates to generating multiple drops weights in a fluid ejection device.

BACKGROUND

As technology progresses, increased performance demands are placed on various components including printing systems. For example, modem printing systems may now handle many different print modes and/or various print media. Furthermore, each print mode and/or print media may use a particular drop weight in order to maximize efficiency of the printing process. That is, when in draft mode, or when operating in high throughput printing conditions, it may be desirable to eject higher weight ink drops from the firing chamber of the printhead. Conversely, photo printing or UIQ (ultimate image quality) printing may be performed more effectively by ejecting lower weight ink drops from the firing chamber of the printhead.

Moreover, UIQ printing is thought to exist only when drop weights are on the order of 1–2 nanograms thereby reaching the visual perception limits of the human eye. Draft mode printing, on the other hand, may typically operate efficiently with ink drop weights of at least 3–6 nanograms. As a result of such different drop weight requirements, a pen having a printhead designed for one type of printing mode or media is often not well suited for use with a separate and different type of printing mode or media.

As yet another concern, the printing mode may not be consistent throughout an entire print job. For example, on a single page it may be desirable to print a high quality image (e.g. a photographic image) on one portion of the page and print a lower quality image (e.g. a monochrome region) on another portion of the page. In such a case, a low drop weight printhead may be used to achieve the photo quality resolution of the photographic image, but such a low drop weight printhead may not be particularly efficient for printing the monochrome region. Thus, a particular printhead which is chosen for its ability to perform photo quality printing, may ultimately reduce the efficiency of an overall printing process.

Thus, a desire has arisen for drop weights that correspond to differing resolutions and that efficiently meet technological demands of sophisticated printing systems.

SUMMARY OF THE INVENTION

In one embodiment, the present invention recites a fluid ejection device comprising a first drop ejector configured to cause fluid having a first drop weight to be ejected from a firing chamber, and includes a first heating element. A first bore, disposed within an orifice layer proximate to the first drop ejector, is associated with the first drop ejector. A second drop ejector is configured to cause fluid having a second drop weight to be ejected from the firing chamber, and includes a second heating element. A second bore, disposed within the orifice layer proximate to the second drop ejector, is associated with the second drop ejector. A voltage source, coupled in series with the first drop ejector and the second drop ejector, is configured to generate a first voltage for activating the first drop ejector individually and a second voltage for activating the first drop ejector and the second drop ejector substantially concurrently.

BRIEF DESCRIPTION OF THE DRAWINGS

The accompanying drawings, which are incorporated in and form a part of this specification, illustrate embodiments of the invention. The drawings referred to in this description should be understood as not being drawn to scale except if specifically noted.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of embodiments of the present invention. However, embodiments of the present invention may be practiced without these specific details.

Figure 1:
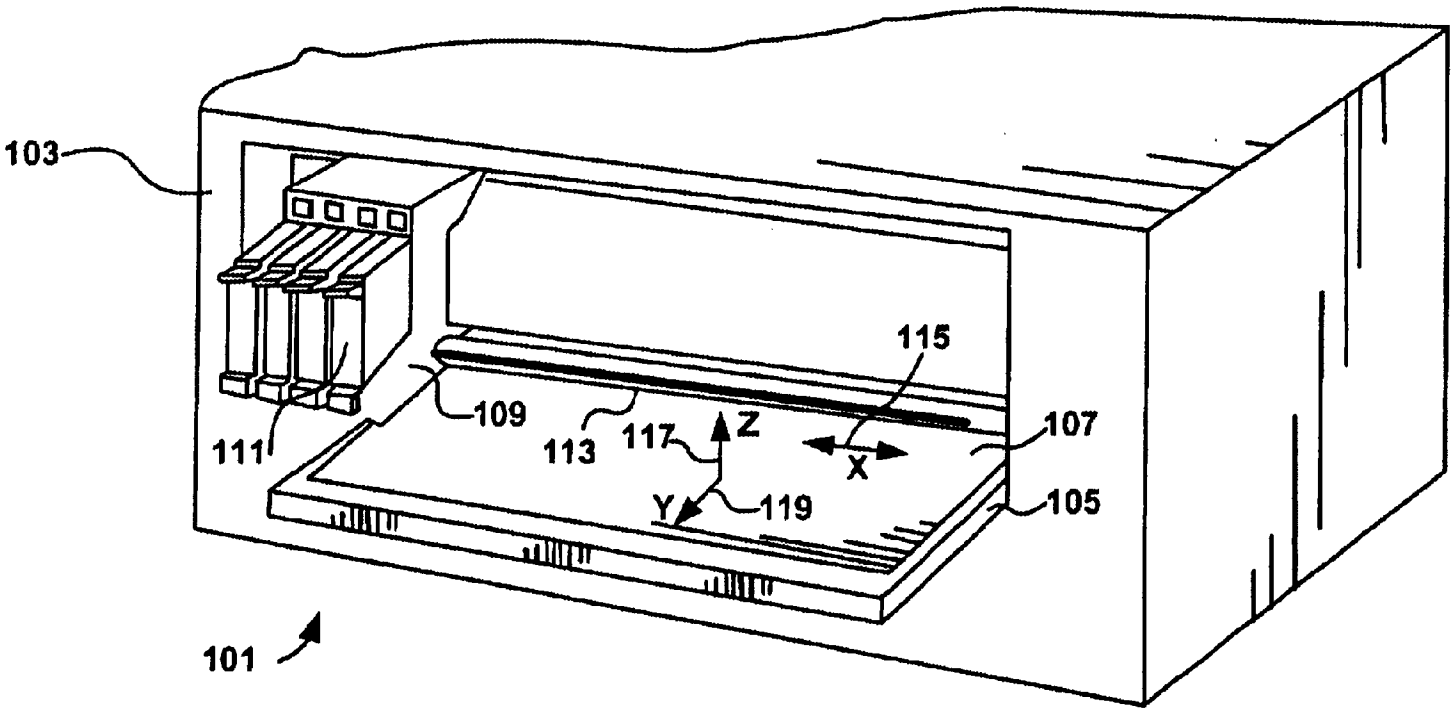
FIG. 1 is a perspective diagram (partial cut-away) of an exemplary printer system in which embodiments of the present invention may be utilized.

The following discussion will begin with a general description of the various structures and devices in which embodiments of the present invention may be employed. This general discussion will be provided in conjunction with FIGS. 1–3. The following discussion will then provide, in conjunction with FIGS. 4–9, a detailed description of the multi-drop weight firing architecture, and corresponding method of manufacture, of the present claimed invention. With reference now to FIG. 1, a perspective diagram (partial cut-away) of an exemplary printer system 101 in which a printhead including a multi-drop weight firing architecture may be employed in accordance with embodiments of the present invention is shown. Exemplary printer system 101 includes a printer housing 103 having platen 105 to which input media 107 (e.g. paper) is transported by mechanisms known in the art. Additionally, exemplary printer system 101 includes a carriage 109 holding at least one replaceable printer component 111 (e.g. a printer cartridge) for ejecting fluid such as ink onto input media 107. Carriage 109 is typically mounted on a slide bar 113 or similar mechanism to allow the carriage 109 to be moved along a scan axis, X, denoted by arrow 115. Also, during typical operation, input media 107 is moved along a feed axis, Y, denoted by arrow 119. Often, input media 107 travels along the feed axis, Y, while ink is ejected along an ink drop trajectory axis, Z, as shown by arrow 117. Exemplary printer system 101 is also well suited to use with replaceable printer components such as semi-permanent printhead mechanisms having at least one small volume, on-board, ink chamber that is sporadically replenished from fluidically-coupled, off-axis, ink reservoirs or replaceable printer components having two or more colors of ink available within the replaceable printer components and ink ejecting nozzles specifically designated for each color. Exemplary printer system 101 is also well suited to use with replaceable printer components of various other types and structures. Although such an exemplary printer system 101 is shown in FIG. 1, embodiments of the present invention, as will be described below in detail, are well suited to use with various other types of printer systems.

Figure 2:
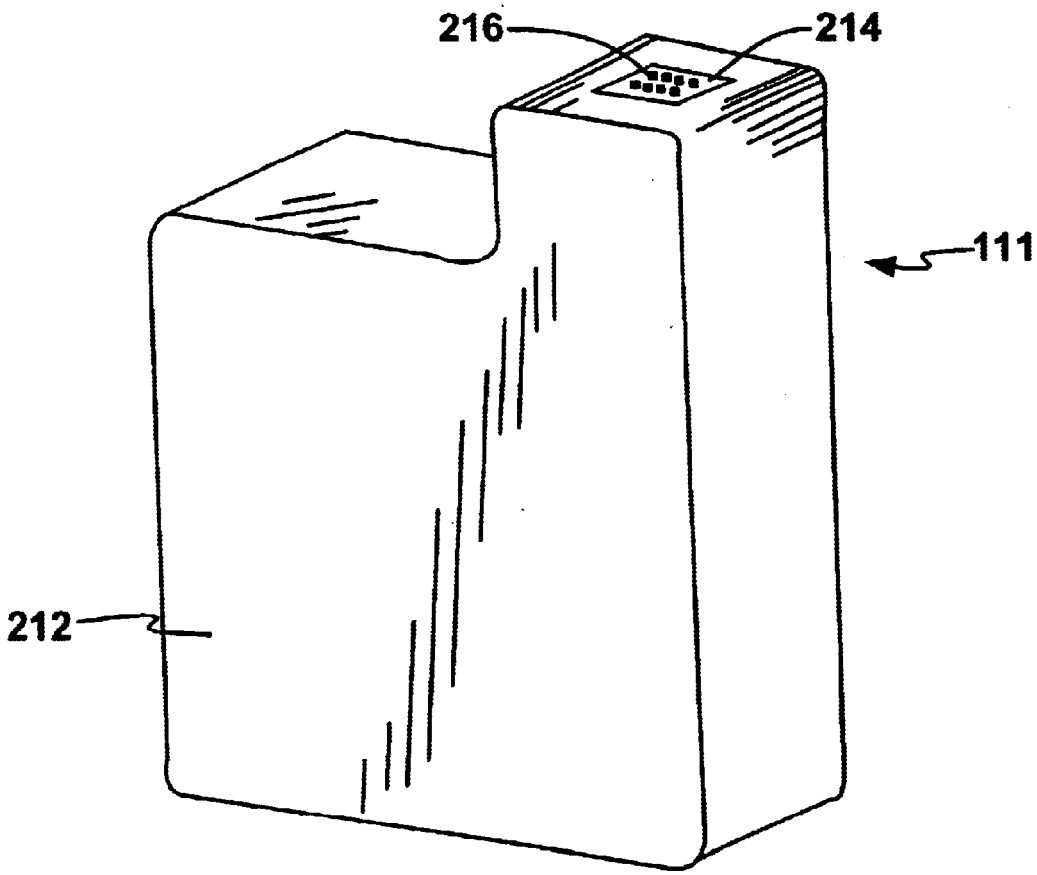
FIG. 2 is a perspective view of a replaceable printer component in which a printhead including a multi-drop weight firing architecture may be employed in accordance with various embodiments of the present claimed invention.

Referring now to FIG. 2, a perspective view is shown of a replaceable printer component 111 in which a printhead including a multi-drop weight firing architecture may be employed in accordance with various embodiments of the present claimed invention. Replaceable printer component 111 is comprised of a housing or shell 212 which contains an internal reservoir of ink (not shown). Replaceable printer component. 111 further contains a printhead 214 with orifices (such as bores) 216 corresponding to firing chambers disposed thereunder. During typical operation, ink is ejected through orifices and is subsequently deposited onto print media 107. Although such a replaceable printer component is shown is FIG. 2, various embodiments of the present invention are well suited to use with numerous other types and/or styles of replaceable printer components.

Figure 3A:
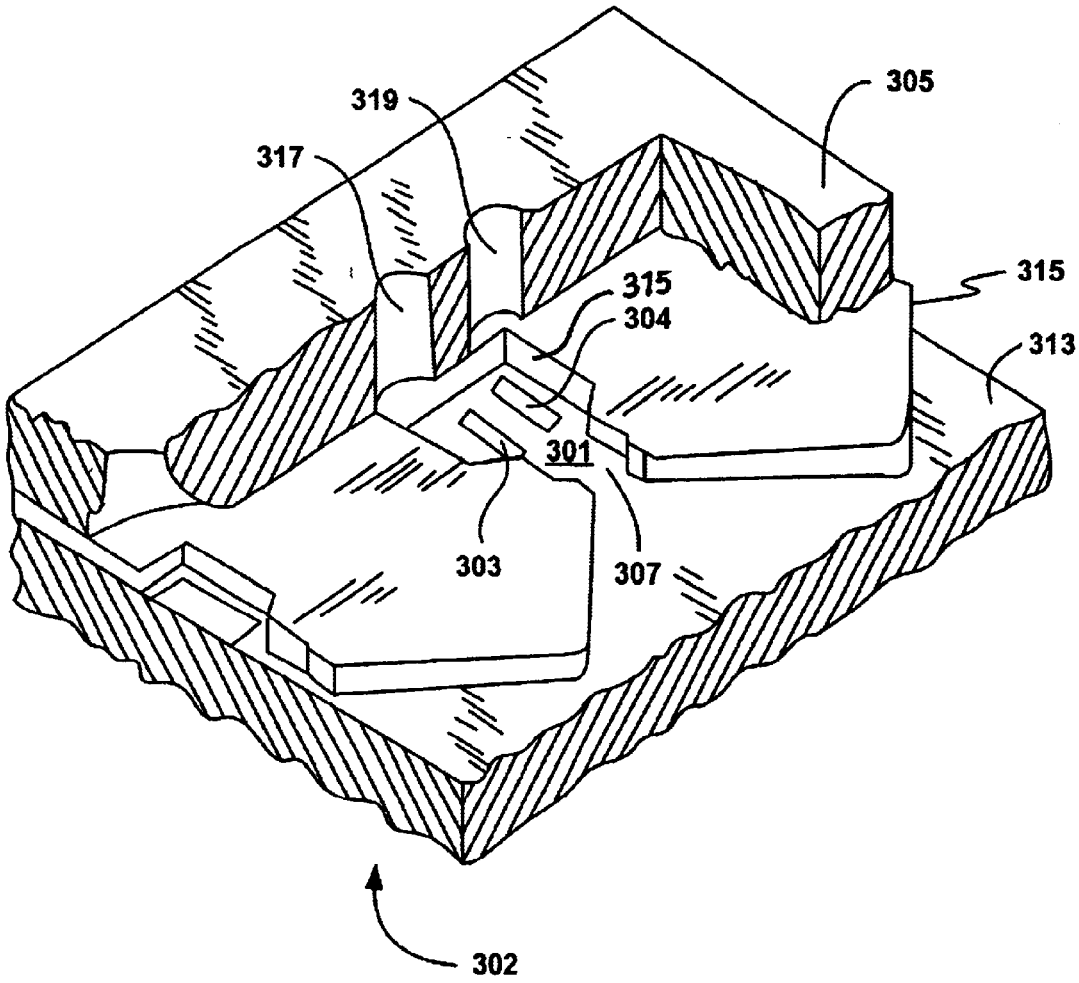
FIG. 3A is a perspective view of a portion of a printhead in accordance with various embodiments of the present claimed invention.

With reference now to FIG. 3A, a perspective view is shown of a portion 302 of a printhead having a multi-drop weight firing architecture in accordance with various embodiments of the present claimed invention. In accordance with one embodiment of the present invention, portion 302 includes a substrate 313 above which is formed a firing chamber 301. As shown in FIG. 3A, in accordance with one embodiment of the present invention, a plurality of drop ejectors 303 and 304 are schematically shown upon the substrate 313 and disposed within firing chamber 301. In the embodiment of FIG. 3A, firing chamber 301 is defined partially by firing chamber walls 315. Additionally, portion 302 of the printhead of FIG. 3A includes an opening 307 through which ink is supplied to firing chamber 301. In the present embodiment, an orifice layer 305 is disposed such that openings or bores 317 and 319 formed therethrough are located proximate and corresponding to drop ejectors 303 and 304 respectively. Furthermore, it will be understood that a single or common firing chamber may also have partial walls or other structures disposed between adjacent drop ejectors. For purposes of the present application, in one embodiment, the terms "common" or "single" firing chamber are defined as given below.

In one embodiment, the bores corresponding to the drop ejectors are less than approximately 1/600th of an inch apart. In another embodiment, a common firing chamber is defined as a firing chamber fed by a single fluid channel or single group of fluid channels.

Figure 3B:
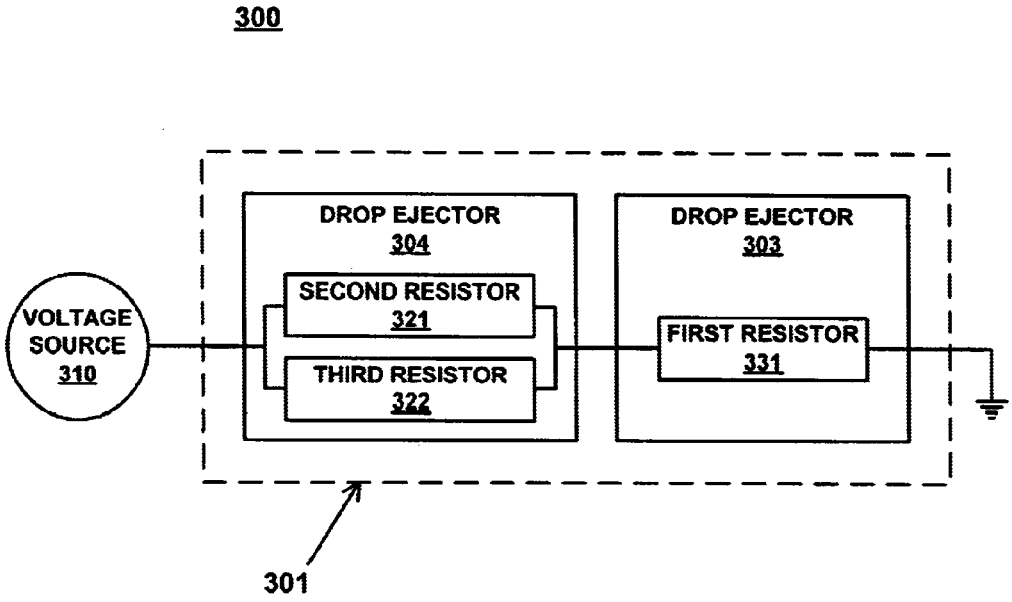
FIG. 3B is a block diagram showing drop ejectors electrically coupled in accordance with various embodiments of the present claimed invention.

Referring now to FIG. 3B, a schematic view showing drop ejectors 303 and 304 electrically coupled in accordance with various embodiments of the present claimed invention. In accordance with embodiments of the present invention, drop ejector 303 is electrically coupled in series with drop ejector 304 and with voltage source 310. In embodiments of the present invention, a resistor 331 is used as a heating element for drop ejector 303.

According to embodiments of the present invention, resistors 321 and 322 are coupled in parallel and comprise at least one heating element for drop ejector 304. When a voltage is generated by voltage source 310 current is divided between resistors 321 and 322 according to the following formulas:

$$I_1=\left(R_1/_{R1+R2}\right)I_T \text{ and}$$

$$I_2=\left(R_2/_{R1+R2}\right)I_T$$

Where $I_1$ is the current flowing through, for example, resistor 321, $I_2$ is the current flowing through resistor 322, $R_1$ is the electrical resistance of resistor 321, $R_2$ is the electrical resistance of resistor 322, and $I_T$ is the total current flow from voltage source 310.

As shown in FIG. 3B, resistors 321 and 322 only receive a portion of the total current from voltage source 310. It is appreciated that the amount of current in either resistor is a function of the electrical resistance of that particular resistor. For example, in one implementation, resistors 321 and 322 have substantially identical electrical resistance properties and therefore the electrical current through each resistor is substantially identical. In another implementation, resistor 321 may, for example, have approximately twice the electrical resistance of resistor 322 and therefore, according to the above formula, the current through resistor 321 would be approximately one half the current through resistor 322. It is appreciated that various electrical resistance values may be utilized in embodiments of the present invention. Furthermore, in embodiments of the present invention, the geometry of circuit 300 may be altered such that electrical current from voltage source 310 is received by drop ejector 303 before being received by drop ejector 304.

Additionally, the current through resistor 321 and 322 is combined so that the current through resistor 331 equals $I_T$. Power, in the form of heat radiated by resistors 321, 322, and 331, is a function of the current through each resistor times the voltage drop across the resistor. In embodiments of the present invention, the sheet resistance and aspect ratio of resistors 321, 322, and 331 are selected so that resistor 331 generates a given amount of heat at a lower voltage than resistors 321 and 322. This is possible in part because of the greater amount of current resistor 331 receives compared to resistors 321 and 322. In embodiments of the present invention, voltage source 310 generates a first voltage that causes resistor 331 to generate sufficient heat to eject fluid from drop ejector 303. However, this first voltage is insufficient to cause either resistor 321 or resistor 322 to generate enough heat to eject fluid from drop ejector 304 because the current is split between second resistor 321 and third resistor 322. Thus, a first voltage is generated by voltage source 310 that is sufficient for causing drop ejector 303 to be initiated individually.

Additionally, in embodiments of the present invention, voltage source 310 is configured for generating a second voltage causing drop ejectors 303 and 304 to be initiated substantially concurrently. For example, a higher voltage results in a higher current across resistors 321 and 322 that results in sufficient heat being generated by resistors 321 and 322 such that fluid is ejected from drop ejector 304. At the same time, this voltage is sufficient such that fluid is also ejected from drop ejector 303. Thus, in embodiments of the present invention, voltage source 310 generates a lower voltage to initiate drop ejector 303 individually, and a higher voltage to initiate drop ejectors 303 and 304 substantially concurrently.

In embodiments of the present invention, the voltage generated by voltage source 310 is dynamically controlled by printer system 101. In one embodiment, first resistor 331 is designed to have a particular surface area and is also designed to receive sufficient current when voltage source 310 generates a first voltage to cause fluid having a desired drop weight to be ejected from firing chamber 301. It will be understood that the size of the drop weight generated by drop ejector 303 can be predetermined by selecting an appropriate heating element surface area and drive circuitry current combination. It will further be understood that the size of the drop weight generated by drop ejector 303 can also be substantially predetermined by selecting an appropriate bore size and/or shape. Likewise, drop ejector 304 is electrically coupled with voltage source 310 and is further configured to cause fluid having a second drop weight to be ejected from firing chamber 301. In one embodiment, second resistor 321 and third resistor 322 are designed to have a particular surface area and are also designed to receive sufficient current when voltage source 310 generates a second voltage to cause fluid having a desired drop weight to be ejected from firing chamber 301.

According to embodiments of the present invention, resistors 321, 322, and 331 are substantially uniform in cross section. In other words, embodiments of the present invention do not utilize patterned resistors, thus facilitating nucleation of fluid across a greater portion of the surface of the resistor that is in contact with the fluid. In printing devices the bubble strength of non-patterned resistors is generally stronger than that of patterned resistors. Additionally, patterned resistors more frequently suffer from device degradation and failure in the patterned region. Thus, embodiments of the present invention provide a multi-drop weight firing architecture that exhibits greater reliability than other implementations.

Figure 4:
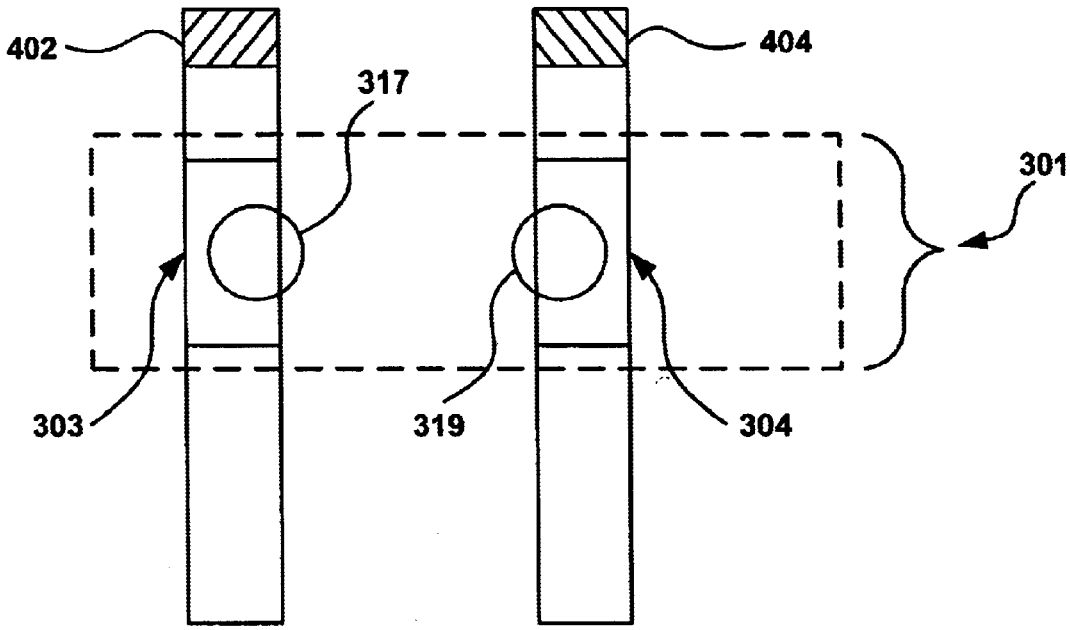
FIG. 4 is a plan view of a plurality of drop ejectors located in a common firing chamber and a plurality of bores located proximate to the common firing chamber of a multi-drop weight firing architecture in accordance with various embodiments of the present claimed invention.

With reference now to FIG. 4, a plan view is shown of a plurality of drop ejectors 303 and 304 located in a common firing chamber 301 and bores 317 and 319 located proximate to common firing chamber 301 of a multi-drop weight firing architecture in accordance with various embodiments of the present claimed invention. Regions 402 and 404 are provided to illustrate possible electrical contact locations for accommodating current flow between drop ejector 304 and drop ejector 303. Furthermore, in the present embodiment, drop ejector 303 is electrically coupled in series with voltage source 310 and drop ejector 304. In one embodiment, drop ejector 303 is designed to cause fluid having a desired drop weight to be ejected from firing chamber 301. It will be understood that the size of the drop weight generated by drop ejector 303 can be predetermined by selecting an appropriate heating element surface area and drive circuitry current combination for resistor 331. Parameters which may be selected to determine these characteristics may include the sheet resistance and/or aspect ratio of resistor 331. It will further be understood that the size of the drop weight generated by drop ejector 303 can also be substantially predetermined by selecting an appropriate size and/or shape for bore 317.

Likewise, drop ejector 304 is electrically coupled in series with voltage source 310 and drop ejector 303 and is further configured to cause fluid having a second drop weight to be ejected from firing chamber 301. In one embodiment, resistors 321 and 322 are designed to have a particular surface area and electrical resistance to cause fluid having a desired drop weight to be ejected from firing chamber 301 when a sufficient voltage is generated by voltage source 310. It will be understood that the size of the drop weight generated by drop ejector 304 can also be predetermined by selecting an appropriate heating element surface area and drive circuitry current combination for resistors 321 and 322. Again it is appreciated that these characteristics may be preselected by altering the sheet resistance and/or aspect ratio of resistors 321 and 322. It will further be understood that the size of the drop weight generated by drop ejector 304 can also be predetermined by selecting an appropriate size and/or shape for bore 319.

By providing a plurality of drop ejectors in a common firing chamber, embodiments of the present embodiment facilitate optimizing printing quality drop weight specifications using a single printhead. As an example, in one embodiment, drop ejector 303 is configured to cause fluid having a drop weight on the order of 1–2 nanograms to be ejected from firing chamber 301. As mentioned above, a 1–2 nanogram drop weight is used to achieve UIQ (ultimate image quality) resolution. Thus, when a first voltage is generated by voltage source 310, drop ejector 303 will cause fluid having a drop weight meeting UIQ printing specifications to be ejected from firing chamber 301 without activating drop ejector 304.

Referring still to FIG. 4, in one embodiment, drop ejector 303 can be activated separately or in a second embodiment drop ejectors 303 and 304 can be activated substantially concurrently. As a result, the present embodiment can further enhance the efficiency of printing, for example, in draft mode by substantially activating drop ejectors 303 and 304 concurrently. In embodiments of the present embodiment, drop ejector 304 is configured to cause fluid having a drop weight on the order of 3 nanograms to be ejected from firing chamber 301. As mentioned above, draft mode printing, for example, may typically operate efficiently with ink drop weights of at least 3–6 nanograms. Thus, when voltage source 310 generates a second voltage, drop ejector 303 and drop ejector 304 are activated substantially concurrently. In so doing, drop ejector 303 will cause fluid having a drop weight on the order of 1–2 nanograms to be ejected from firing chamber 301 concurrent with drop ejector 304 causing fluid having a drop weight on the order of 3 nanograms to be ejected from firing chamber 301. Thus, a total drop weight of 4–5 nanograms will be ejected from firing chamber 301 which is commensurate with drafting mode printing specifications of a drop weight of approximately 3–6 nanograms. This increased total drop weight enables greater media throughput speeds while maintaining print quality.

The multi-drop weight firing architecture of embodiments of the present invention are also well suited to dynamically selecting the cumulative drop weight ejected from firing chamber 301. In embodiments of the present invention, the voltage generated by voltage source 310 is dynamically controlled by printer system 101. Thus, when printer system 101 is printing a portion of a document requiring image quality resolution, a control signal is sent to voltage source 310 causing it to generate a first voltage that activates drop ejector 303 individually (e.g., without activating drop ejector 304). When a portion of the same document requires lower quality resolution, a control signal is sent to voltage source 310 causing it to generate a second voltage that substantially activates drop ejectors 303 and 304 concurrently. Hence, the multi-drop weight firing architecture of the present embodiment is able to selectively generate, from a single firing chamber 301, a drop weight of 1–2 nanograms, or a drop weight of 4–5 nanograms. It should be noted that embodiments of the present invention are not limited to the specific drop weight examples given above. That is, embodiments of the present invention are well suited to generating various other drop sizes for one or both of drop ejectors 303 and 304. For example, both drop ejector 303 and drop ejector 304 can be configured to cause fluid having a drop weight on the order of 1–2 nanograms to be ejected from firing chamber 301.

Such an embodiment is particularly beneficial, for example, when the printing mode is not consistent throughout an entire print job. For purpose of illustration of the present embodiment, assume it is desirable to print a high quality image (e.g. a photographic image) on one portion of a page and print a lower quality image (e.g. a monochrome region) on another portion of the page. In such a case, the present embodiment will dynamically cease firing of drop ejector 304, and instead activate only drop ejector 303, thereby causing fluid having a drop weight on the order of 1–2 nanograms to be ejected from firing chamber 301. Hence, the present embodiment will dynamically generate the low drop weight to achieve the resolution to properly print the photographic image. When it is no longer useful to generate the low drop weight, embodiments of the present invention are well suited to dynamically activating both drop ejector 303 and drop ejector 304 to produce a cumulative drop weight of 4–5 nanograms to even further increase printing efficiency throughout. Once again, it should be noted that embodiments of the present invention are not limited to the specific drop weight examples given above. That is, embodiments of the present invention are well suited to generating various other drop sizes for one or both of drop ejectors 303 and 304.

Thus, the present embodiment of the multi-drop weight firing architecture is able to accommodate multiple printing modes or media with, for example, a single printhead. Furthermore, the multi-drop weight firing architecture of the present embodiment is able to accommodate multiple printing modes or types using a single printhead and without ultimately reducing the efficiency of an overall printing process.

In one embodiment, the multi-drop weight firing architecture is compatible with existing firing chamber, printhead, and printer component fabrication processes. That is, the present multi-drop weight firing architecture can be manufactured using existing fabrication processes and equipment.

With reference again to FIG. 4, in one embodiment of the present invention, bores 317 and 319 are formed proximate to and correspond with drop ejector 303 and drop ejector 304, respectively. In the present embodiment, bore 317 is disposed to direct the flow or trajectory of fluid which drop ejector 303 causes to be ejected from firing chamber 301. Similarly, bore 319 is disposed to direct the flow or trajectory of fluid which drop ejector 304 causes to be ejected from firing chamber 301. In the embodiment of FIG. 4, bores 317 and 319 are disposed offset from drop ejector 303 and drop ejector 304, respectively. That is, the center of bore 317 is not centered with respect to drop ejector 303, and, similarly, the center of bore 319 is not centered with respect to drop ejector 304. The orientation and function of bores 317 and 319 are further described in conjunction with FIGS. 5A and 5B below.

Figure 5A:
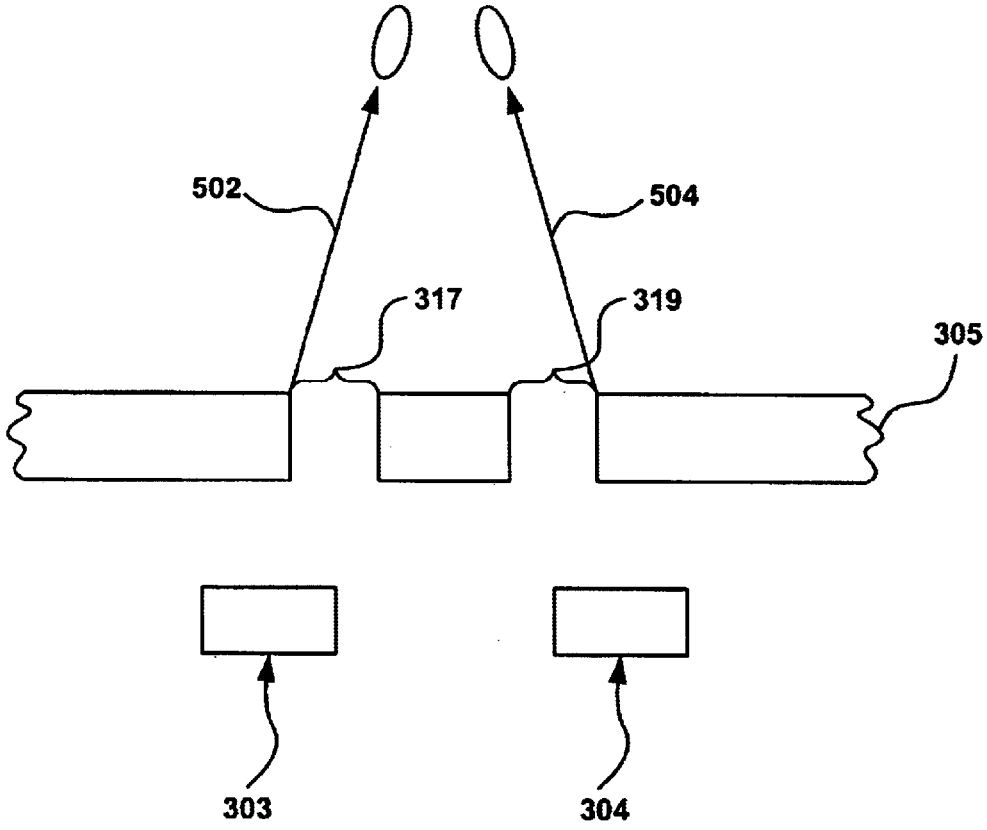
FIG. 5A is a side sectional schematic view of a plurality of drop ejectors and corresponding offset bores located proximate to the common firing chamber of a multi-drop weight firing architecture in accordance with various embodiments of the present claimed invention.

Referring now to FIG. 5A, a side sectional schematic view is shown of a plurality of drop ejectors 303 and 304 located in a common firing chamber, and corresponding offset bores 317 and 319, respectively, formed through, for example, an orifice layer 305. As shown in FIG. 5A, in one embodiment of the present invention, bores 317 and 319 are disposed offset from (i.e. not centered with respect to) drop ejector 303 and drop ejector 304, respectively. In so doing, fluid which drop ejector 303 causes to be ejected from the common firing chamber is directed along an angled trajectory as schematically indicated by arrow 502. Likewise, in the embodiment of FIG. 5A, fluid which drop ejector 304 causes to be ejected from the common firing chamber is directed along an angled trajectory as schematically indicated by arrow 504. In so doing, the present embodiment is able to direct or "aim" the ejected fluid in a desired direction. In one embodiment, the ejected fluid is directed towards a common location such as, for example, a desired pixel location on a print medium. Although both of bores 317 and 319 are disposed in an offset orientation in the present embodiment, embodiments of the present invention are also well suited to an embodiment in which only one or the other of bores 317 and 319 are centered over their corresponding drop ejector. Furthermore, embodiments of the present invention are also well suited to an embodiment in which the trajectory of the ejected fluid is other than that shown in the embodiment of FIG. 5A.

Figure 5B:
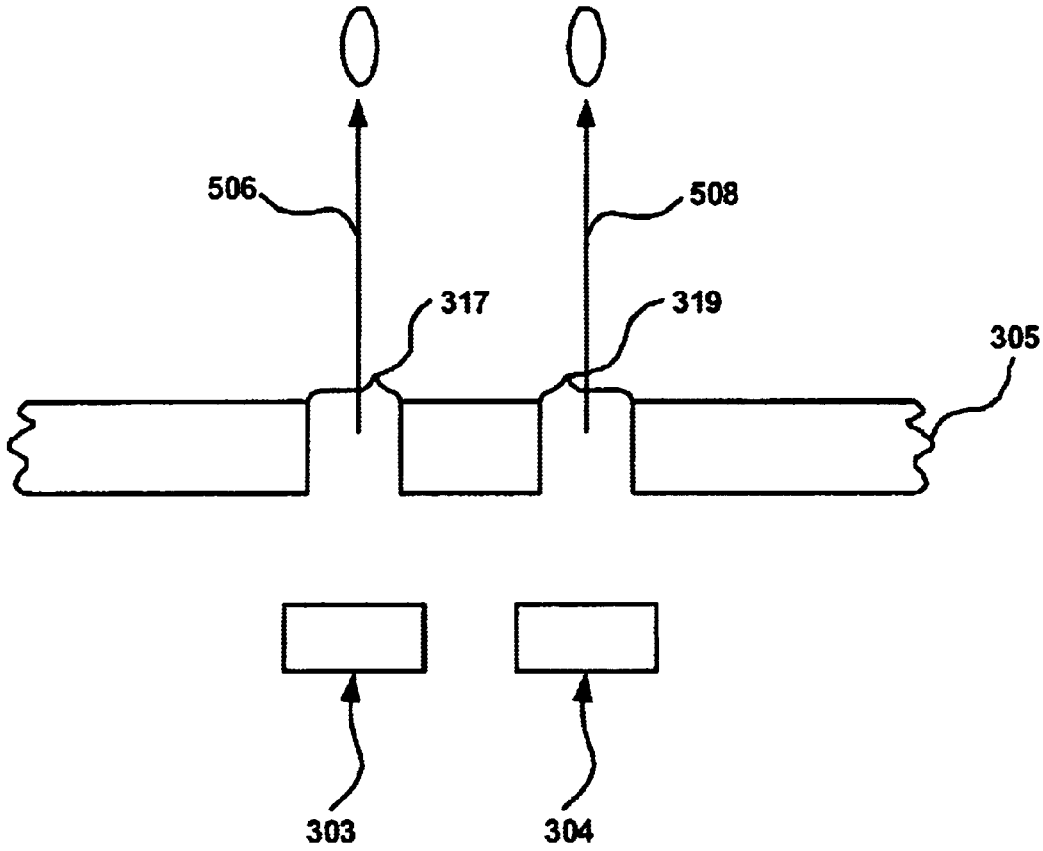
FIG. 5B is a side sectional schematic view of a plurality of drop ejectors and corresponding bores located proximate to the common firing chamber of a multi-drop weight firing architecture in accordance with various embodiments of the present claimed invention.

With reference now to FIG. 5B, a side sectional schematic view is shown of a plurality of drop ejectors 303 and 304 located in a common firing chamber, and corresponding aligned bores 317 and 319, respectively, formed through, for example, an orifice layer 305. As shown in FIG. 5B, in one embodiment of the present invention, bores 317 and 319 are disposed aligned with (i.e. centered with respect to) drop ejector 303 and drop ejector 304, respectively. In so doing, fluid which drop ejector 303 causes to be ejected from the common firing chamber is directed along a trajectory as indicated by arrow 506. Likewise, in the embodiment of FIG. 5B, fluid which drop ejector 304 causes to be ejected from the common firing chamber is directed along a trajectory as indicated by arrow 508 which is substantially parallel to the trajectory indicated by arrow 506. Although both of bores 317 and 319 are disposed in a centered orientation in the present embodiment, embodiments of the present invention are also well suited to an embodiment in which only one or the other of bores 317 and 319 are centered with their corresponding drop ejector.

Figure 6:
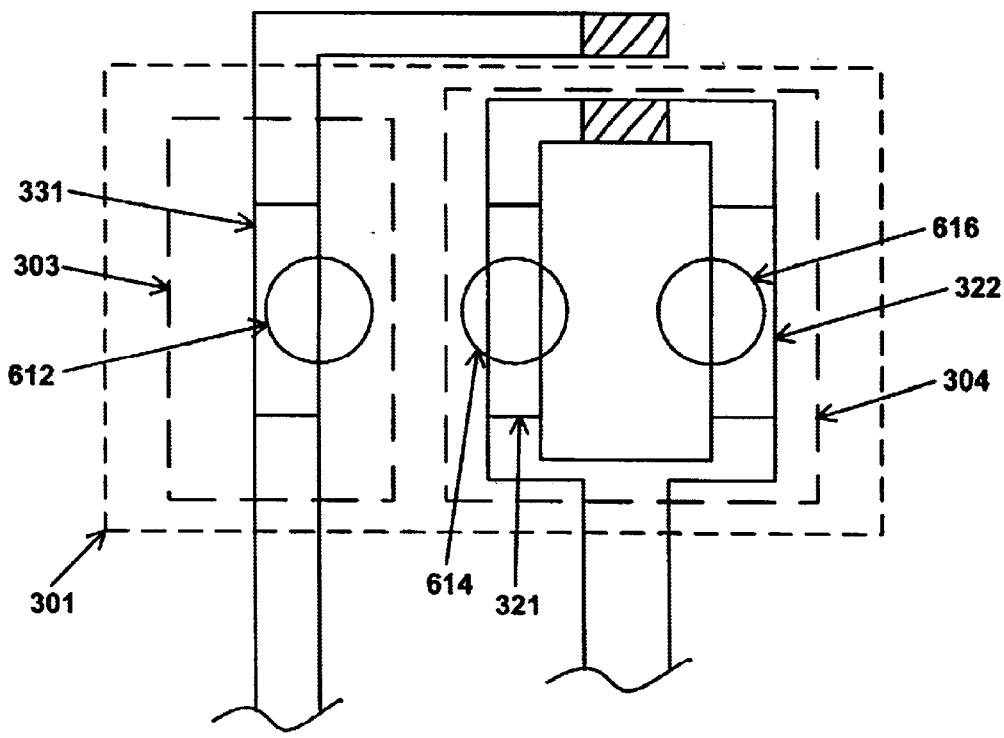
FIG. 6 is a plan view of another configuration of a plurality of drop ejectors and corresponding bores located proximate to the common firing chamber of a multi-drop weight firing architecture in accordance with various embodiments of the present claimed invention.

With reference now to FIG. 6, a plan view is shown, in accordance with one embodiment of the present claimed invention. In the embodiment of FIG. 6, the present embodiment provides a multi-drop weight firing architecture which can selectively eject up to three separate drops from common firing chamber 601. That is, the present embodiment can eject fluid having a first drop weight as is generated by drop ejector 303 individually. Additionally, the present embodiment can eject fluid having a first drop weight and a second drop weight, as is generated by drop ejectors 303 and 304, substantially concurrently. Lastly, the present embodiment can eject fluid having the first drop weight, fluid having the second drop weight, and fluid having the third drop weight as is generated by drop ejectors 303 and 304 substantially concurrently.

In the embodiment of FIG. 6, bore 612 is disposed in firing chamber 301 proximate to drop ejector 303. Drop ejector 303 is electrically coupled with drop ejector 304 and is further configured to cause fluid having a first drop weight to be ejected from firing chamber 301. In one embodiment, the sheet resistance and aspect ratio of first resistor 331 are selected such that first resistor 331 has a particular surface area and receives sufficient current to cause fluid having a desired drop weight to be ejected from firing chamber 301. It will be understood that the size of the drop weight generated by drop ejector 303 can also be predetermined by selecting an appropriate bore size and/or shape for bore 612.

Furthermore, in the present embodiment, drop ejector 304 comprises second resistor 321 and third resistor 322 coupled in parallel and which are configured to cause fluid having a second drop weight and a third drop weight, respectively, to be ejected from firing chamber 301. Bores 614 and 616 are disposed proximate to resistors 321 and 322 respectively. In one embodiment, second resistor 321 and third resistor 322 are designed to have particular, respective, surface areas and are also designed with differing electrical resistance values such that fluid having the desired second and third drop weights can be selectively ejected from firing chamber 601 depending upon the voltage generated by voltage source 310. It will be understood that the size of the second and third drop weights generated by drop ejector 304, can also be predetermined by selecting an appropriate bore size and/or shape for bores 614 and 616.

Although such a structural configuration is shown in the embodiment of FIG. 6, embodiments of the present invention are well suited to various other configurations for the present multi-drop weight firing architecture. For example, the present invention is also well suited to an embodiment which includes more than three drop ejectors within a common firing chamber. The present embodiment is also well suited to an embodiment in which a single drop ejector is configured to substantially concurrently cause the generation of more than two drops of fluid to be ejected from a firing chamber. More generally, the embodiment of the present multi-firing architecture is comprised of at least two drop ejectors coupled to a voltage source.

In the present embodiment, a first voltage from voltage source 310 activates drop ejector 303 separately from drop ejector 304. That is, sufficient current passes through first resistor 331 to cause fluid having a first drop weight to be ejected from firing chamber 301 (via bore 612). However, insufficient current passes through either of the resistors comprising fluid ejector 304 to initiate ejecting fluid from fluid ejector 304. This is due, in part, to the fact that the current from voltage source 310 is split between second resistor 321 and third resistor 322. Thus, the first voltage generated by voltage source 310 passes insufficient current through second resistor 321 and third resistor 322 in parallel to cause ejection of fluid from drop ejector 304. However, the combined current passing through first resistor 331 is sufficient to cause ejection of fluid having a first drop weight from drop ejector 303.

Additionally, in the present embodiment, a second voltage from voltage source 310 activates drop ejector 303 and 304 such that fluid having a first drop weight and fluid having a second drop weight are ejected from firing chamber 301 substantially concurrently. In other words, sufficient current passes through second resistor 321 such that it causes fluid having a second drop weight to be ejected via bore 614. However, due to the different electrical resistance values of resistors 321 and 322, third resistor 322 does not receive enough current to cause ejection of fluid from firing chamber 301. Additionally, the second voltage passes sufficient voltage through resistor 331 such that drop ejector 303 and drop ejector 304 are activated substantially concurrently.

In the present embodiment, a third voltage from voltage source 310 activates drop ejectors 303 and 304 such that fluid-having a first drop weight, fluid having a second drop weight, and fluid having a third drop weight are ejected from firing chamber 301 substantially concurrently. In other words, sufficient current passes through first resistor 331 to cause fluid having a first drop weight to be ejected from firing chamber 301 via bore 612. Additionally, sufficient current passes through second resistor 321 such that fluid having a second drop weight is ejected from firing chamber 301 via bore 614. Finally, sufficient current passes through third resistor 322 such that fluid having a third drop weight is ejected from firing chamber 301 via bore 616.

Referring still to FIG. 6, in one embodiment, drop ejector 303 is configured to cause fluid having a drop weight on the order of 2 nanograms to be ejected from firing chamber 301. A 1–2 nanogram drop weight achieves UIQ (ultimate image quality) resolution in one embodiment. Thus, when only drop ejector 303 is activated, it will cause fluid having a drop weight meeting UIQ printing specifications to be ejected from firing chamber 301. Furthermore, in the present embodiment, drop ejector 304 is configured to cause fluid having a second drop weight on the order of 4 nanograms to be ejected from firing chamber 301 via bore 614. As mentioned above, draft mode printing, for example, may typically operate efficiently with ink drop weights of at least 3–6 nanograms. Thus, when a second voltage is generated by voltage source 310, drop ejectors 303 and 304 will cause fluid having a combined drop weight of 6 nanograms (i.e. a drop weight commensurate with drafting mode printing requirements) to be ejected from firing chamber 301.

Referring still to FIG. 6, when voltage source 310 generates a third voltage, first resistor 331, second resistor 321, and third resistor 322 receive sufficient current such that fluid having a first fluid weight is ejected from drop ejector 303 substantially concurrent with fluid having a second drop weight and a third drop weight being ejected from drop ejector 304. As a result, the present embodiment can further enhance the efficiency of printing, for example, in draft mode by substantially concurrently activating drop ejectors 303 and 304 such that fluid is ejected substantially concurrently via bores 612, 614, and 616. In so doing, drop ejector 303 will cause fluid having a drop weight on the order of 2 nanograms to be ejected from firing chamber 301 substantially concurrent with each of drop ejectors 602 and 606 causing fluid having a drop weight on the order of, for example, 4 nanograms to be ejected from each of bores 614 and 616. Thus, a total drop weight of 10 nanograms is produced by the present embodiment. This increased total drop weight enables greater media throughput speeds while maintaining print quality. Hence, the multi-drop weight firing architecture of the present embodiment is able to selectively generate, from a single firing chamber 301, a drop weight of 2 nanograms, a drop weight of 6 nanograms, or a drop weight of 10 nanograms. It should be noted that embodiments of the present invention are not limited to the specific drop weight examples given above. That is, embodiments of the present invention are well suited to generating various other drop sizes for one or both of drop ejectors 303 and 304.

One embodiment of the multi-drop weight firing architecture of embodiments of the present invention are also well suited to dynamically selecting the cumulative drop weight ejected from firing chamber 301. Such an embodiment is particularly beneficial, for example, when the printing mode is not consistent throughout an entire print job. For purpose of illustration of the present embodiment, assume it is desirable to print a high quality image (e.g. a photographic image) on one portion of a page and print a lower quality image (e.g. a monochrome region) on another portion of the page. In such a case, the present embodiment will selectively activate drop ejectors 303 and 304 using voltage source 310 and thereby cause fluid having a cumulative drop weight on the order of 6–10 nanograms to be ejected from firing chamber 301. Hence, the present embodiment will generate the higher drop weight to more efficiently print the monochrome region.

Moreover, when printing the photographic image on the page, the present embodiment will dynamically cease firing of drop ejector 304, and instead activate only drop ejector 303 thereby causing fluid having a drop weight on the order of 2 nanograms to be ejected from firing chamber 301. Hence, the present embodiment will dynamically generate the low drop weight to achieve the resolution that properly prints the photographic image. When it is no longer useful to generate the low drop weight, the present embodiment can dynamically re-activate drop ejector 304 using voltage source 310 to increase printing efficiency and throughput. Also, while printing the lower quality image, embodiments of the present invention are well suited to dynamically activating drop ejectors 303 and 304 to produce a cumulative drop weight of 10 nanograms to even further increase printing efficiency throughout. Once again, it should be noted that embodiments of the present invention are not limited to the specific drop weight examples given above. That is, embodiments of the present invention are well suited to generating various other drop sizes for one or both of drop ejectors 303 and 304.

Thus, an embodiment of the present multi-drop weight firing architecture is able to accommodate multiple printing modes or media with, for example, a single printhead. Furthermore, the multi-drop weight firing architecture of the present embodiment is able to accommodate multiple printing modes or types using a single printhead and without ultimately reducing the efficiency of an overall printing process.

In one embodiment, the multi-drop weight firing architecture of the present embodiment is compatible with existing firing chamber, printhead, and printer component fabrication processes. That is, the present multi-drop weight firing architecture can be manufactured using existing fabrication processes and equipment.

With reference again to FIG. 6, in one embodiment of the present invention, bore 612 is formed proximate to and corresponds with drop ejector 303. Similarly, bores 614 and 616 are formed proximate to and correspond with drop ejector 304. In the present embodiment, bore 612 is disposed to direct the flow or trajectory of fluid which drop ejector 303 causes to be ejected from firing chamber 301. Similarly, bores 614 and 616 are disposed to direct the flow or trajectory of fluid which drop ejector 304 causes to be ejected from firing chamber 301. Also, bore 614 is disposed to direct the flow or trajectory of fluid which second resistor 321 causes to be ejected from firing chamber 301 and bore 616 is disposed to direct the flow or trajectory of fluid which third resistor 322 causes to be ejected from firing chamber 301. In the embodiment of FIG. 6, bores 612 and 616 are disposed offset from resistors 331 and 322, respectively. That is, the center of bore 612 is not centered with respect to resistor 331, and, similarly, the center of bore 616 is not centered with respect to resistor 322. The orientation and function of bores 612, 614, and 616 are further described in conjunction with FIGS. 7A and 7B below.

Figure 7A:
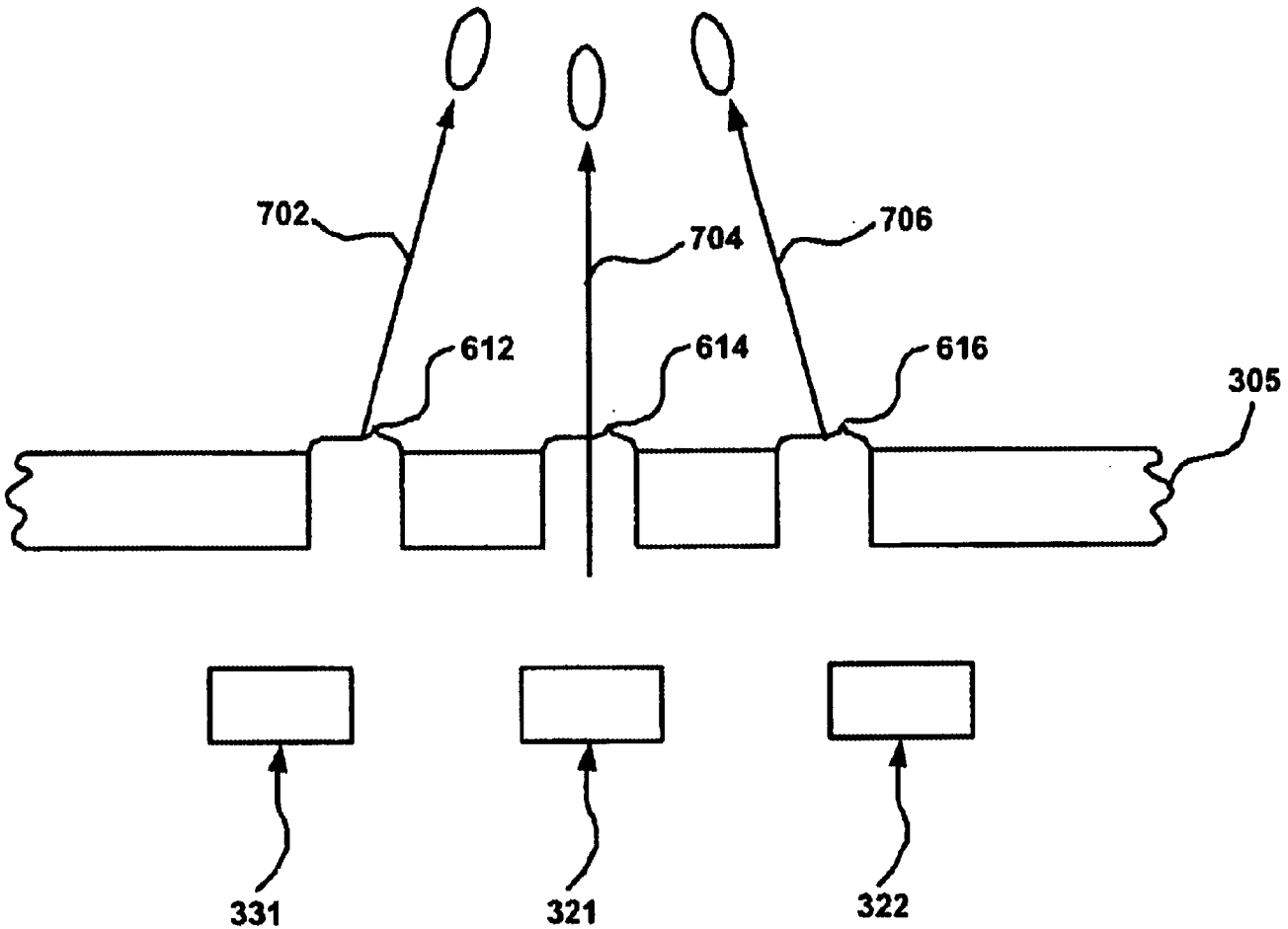
FIG. 7A is a side sectional schematic view of a plurality of drop ejectors and corresponding bores (some of which are offset) located proximate to the common firing chamber of a multi-drop weight firing architecture in accordance with various embodiments of the present claimed invention.

Referring now to FIG. 7A, a side sectional schematic view is shown of a plurality of drop ejectors 302 and 304, located in a common firing chamber, and bores 612, 614, and 616 formed through, for example, an orifice layer 305. As shown in FIG. 7A, in one embodiment of the present invention, bores 612 and 616 are disposed offset from (i.e. not centered with respect to) first resistor 331 and third resistor 322, respectively. In so doing, fluid which drop ejector 303 causes to be ejected from the common firing chamber is directed along an angled trajectory as schematically indicated by arrow 702. Likewise, in the embodiment of FIG. 7A, fluid which third resistor 322 causes to be ejected from the common firing chamber is directed along an angled trajectory as schematically indicated by arrow 706. In so doing, the present embodiment is able to direct or "aim" the ejected fluid in a desired direction. In one embodiment, the ejected fluid from bores 612, 614, and 616 is directed towards a common location such as, for example, a desired pixel location on a print medium. In the embodiment of FIG. 7A, bore 614 is not offset from second resistor 321 such that fluid ejected the common firing chamber is directed along the trajectory indicated by arrow 704. Although bores 612 and 616 are disposed in an offset orientation in the present embodiment, the present invention is also well suited to an embodiment in which only one or the other of bores 612 and 616 are offset from their corresponding drop ejector. The present invention is also well suited to an embodiment in which bore 614 is also offset from second resistor 321. Furthermore, the present invention is also well suited to an embodiment in which the trajectory of the ejected fluid is other that that shown in the embodiment of FIG. 7A.

Figure 7B:
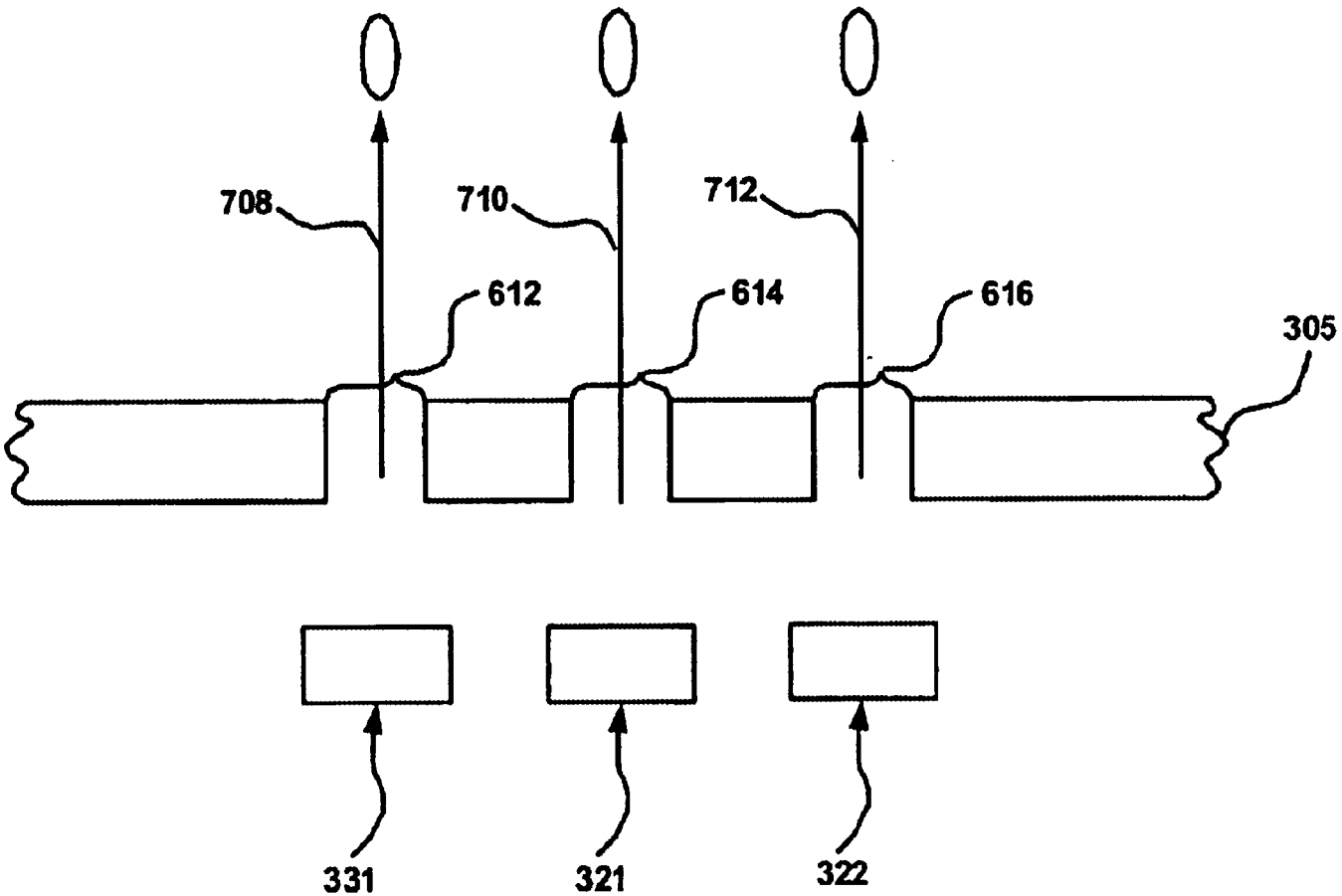
FIG. 7B is a side sectional schematic view of a plurality of drop ejectors and corresponding bores located proximate to the common firing chamber of a multi-drop weight firing architecture in accordance with various embodiments of the present claimed invention.

With reference now to FIG. 7B, a side sectional schematic view is shown of a plurality of drop ejectors 303 and 304 are located in a common firing chamber, and corresponding aligned bores 612, 614, and 616 are formed through, for example, an orifice layer 305. As shown in FIG. 7B, in one embodiment of the present invention, bores 612, 614, and 616 are disposed aligned with (i.e. centered with respect to) first resistor 331, second resistor 321, and third resistor 322, respectively. In so doing, fluid which drop ejector 303 causes to be ejected from the common firing chamber is directed along a trajectory as indicated by arrow 708 which is substantially parallel to the trajectory indicated by arrows 710 and 712. Likewise, in the embodiment of FIG. 7B, fluid which drop ejector 304 causes to be ejected from the common firing chamber via bore 614 is directed along a trajectory as schematically indicated by arrow 710 which is substantially parallel to the trajectory schematically indicated by arrows 708 and 712. Also, in the embodiment of FIG. 7B, fluid which drop ejector 304 causes to be ejected from the common firing chamber via bore 616 is directed along a trajectory as schematically indicated by arrow 712 which is substantially parallel to the trajectory schematically indicated by arrows 708 and 710. Although each of bores 612, 614, and 616 are disposed in a centered orientation in the present embodiment, the present invention is also well suited to an embodiment in which less than all of bores 612, 614, and 616 are centered with their corresponding resistor.

Figure 8A:
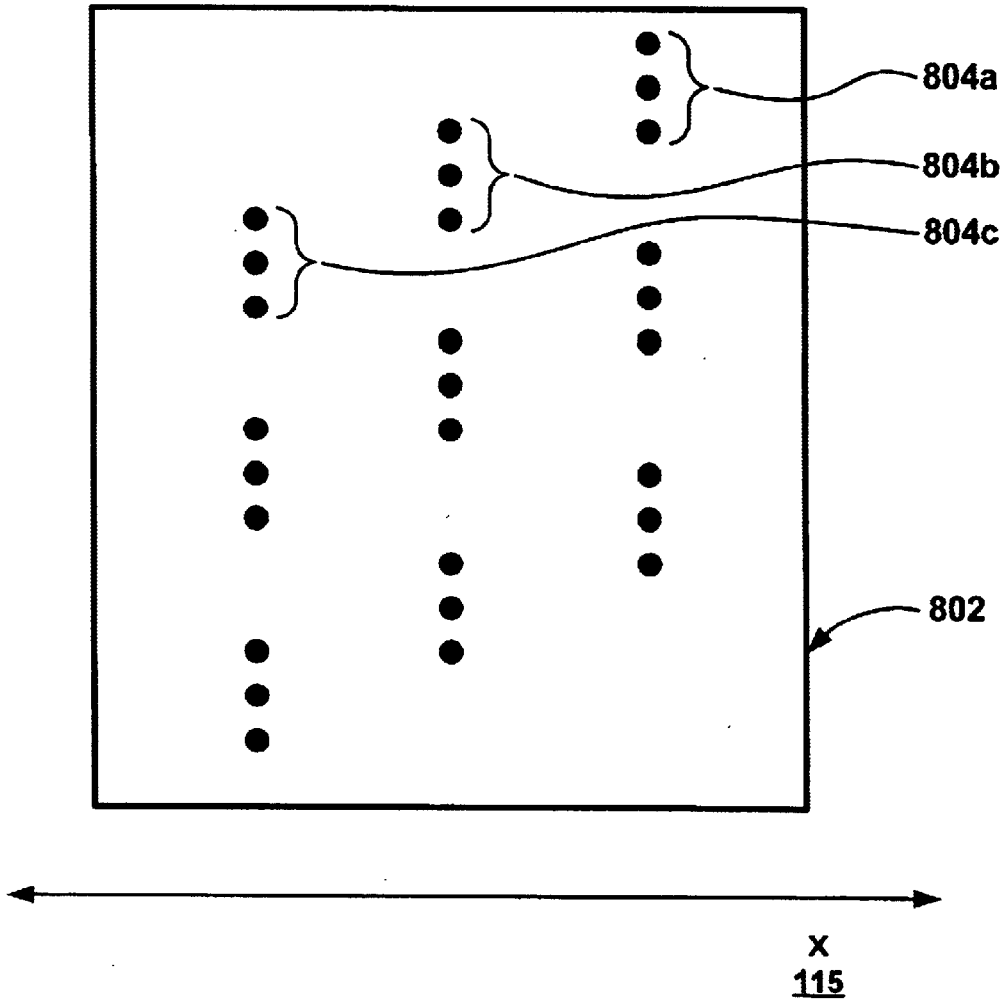
FIG. 8A is a plan view of one orientation of a plurality of bores on a printhead in which a plurality of heating elements are disposed in a common firing chamber in accordance with various embodiments of the present claimed invention.

With reference now to FIG. 8A, a schematic plan view is shown of one orientation of a plurality of bores on a printhead 802 in which a plurality of drop ejectors are disposed in a common firing chamber in accordance with various embodiments of the present claimed multi-drop weight firing architecture. In the present embodiment, a schematically depicted printhead 802 is shown having an orifice layer with sets of staggered bores 804*a*, 804*b*, and 804*c* arranged thereon. In one embodiment, the sets of staggered bores 804*a*, 804*b*, and 804*c*, correspond to, for example, bores 612, 614, and 616. Although such an orientation is shown in the present embodiment, embodiments of the present invention are also well suited to various other orientations for the bores.

Figure 8B:
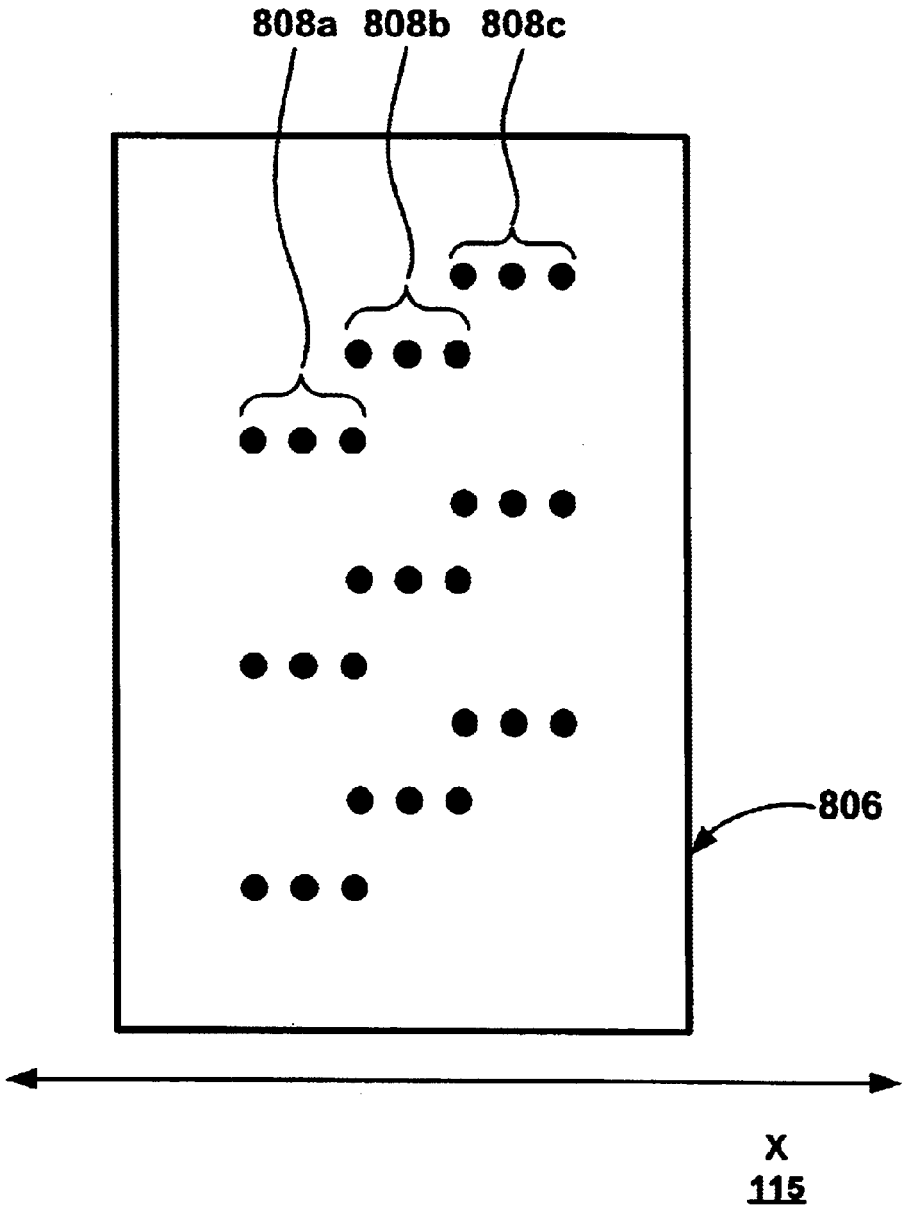
FIG. 8B is a plan view of another orientation of a plurality of bores on a printhead in which a plurality of heating elements are disposed in a common firing chamber in accordance with various embodiments of the present claimed invention.

Referring next to FIG. 8B, a schematic plan view is shown of another orientation of a set of bores in an orifice layer in which a plurality of drop ejectors are disposed in a common firing chamber in accordance with various embodiments of the present claimed multi-drop weight firing architecture. In the present embodiment, a schematically depicted orifice layer is shown having a set of staggered bores 808*a*, 808*b*, and 808*c* arranged thereon. For example, sets of staggered bores 808*a*, 808*b*, and 808*c*, correspond with, for example, bores 612, 614, and 616. Although such an orientation is shown in the present embodiment, embodiments of the present invention are also well suited to various other orientations for the bores.

Figure 9:
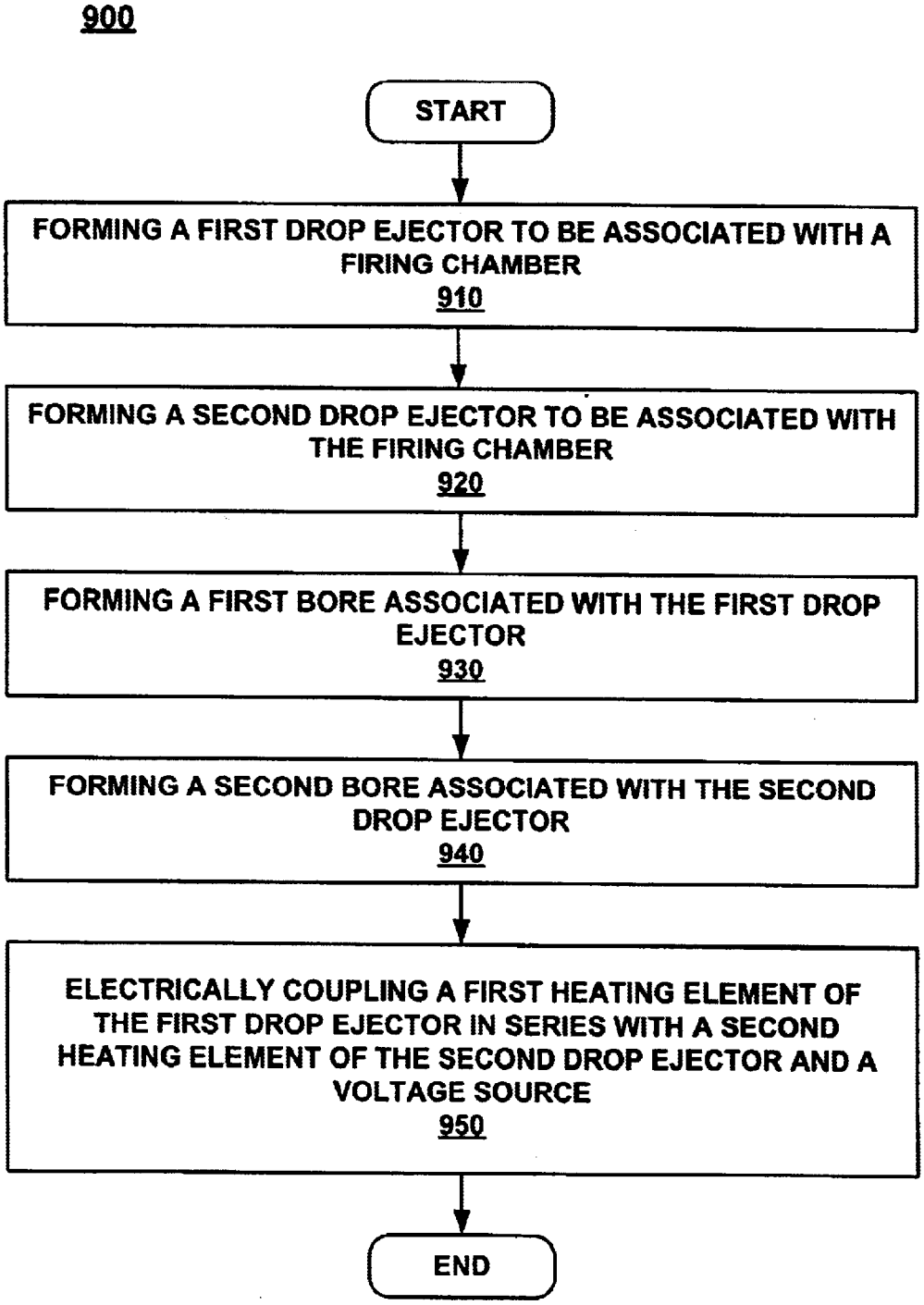
FIG. 9 is a flow chart of steps performed during the manufacturing of a fluid ejection device having a plurality of heating elements located in a common firing chamber in accordance with one embodiment of the present claimed invention.

With reference next to FIG. 9, a flow chart 900 is shown of steps performed during the manufacture of one embodiment of the present multi-drop weight firing architecture. At step 910, a first drop ejector (e.g., drop ejector 303 of FIG. 3) is formed which is associated with a firing chamber. In embodiments of the present invention, and in the manner described above in detail in conjunction with the discussion of FIG. 4, fluid having a first fluid weight can be ejected from the firing chamber by the first drop ejector.

At step 920 of flowchart 900, a second drop ejector (e.g., drop ejector 304 of FIG. 3) is formed which is associated with the firing chamber. In embodiments of the present invention, and in the manner described above in detail in conjunction with the discussion of FIG. 4, fluid having a second fluid weight can be ejected from the firing chamber by the second drop ejector. In embodiments of the present invention, the first drop ejector and the second drop ejector are formed such that the first drop weight is different from the second drop weight. Embodiments of the present invention are well suited to forming the first drop ejector and the second drop ejector such that the first drop weight is substantially the same as the second drop weight. Additionally, in embodiments of the present invention, the second drop ejector is configured such that fluid having a third drop weight can be ejected from the firing chamber. In embodiments of the present invention, the first drop ejector and the second drop ejector are formed such that the first drop weight is different from the second drop weight and the third drop weight. However, embodiments of the present invention are well suited to forming the first drop ejector and the second drop ejector such that the first drop weight and/or the second drop weight are substantially the same as the third drop weigh. In embodiments of the present invention, step 920 may be performed before step 910 or concurrently therewith.

At step 930 of flowchart 900, a first bore associated with the first drop ejector is formed. In embodiments of the present invention, the first bore is disposed to direct fluid having the first drop weight when ejected from the firing chamber. In so doing embodiments of the present invention are able to direct the fluid having the first drop weight in a desired direction. In embodiments of the present invention, the size of the first drop weight generated by the first drop ejector may be determined by the size and/or shape of the first bore.

At step 940 of flowchart 900, a second bore associated with the second drop ejector is formed. In embodiments of the present invention, the second bore is disposed to direct fluid having the second drop weight when ejected from the firing chamber. In so doing embodiments of the present invention are able to direct the fluid having the second drop weight in a desired direction. In embodiments of the present invention, the size of the second drop weight generated by the second drop ejector may be determined by the size and/or shape of the second bore. In embodiments of the present invention, step 940 may be performed before step 930 or concurrently therewith.

In another embodiment of the present invention, and in the manner described above in detail in conjunction with the discussion of FIG. 6, a third bore is also associated with the second drop ejector. The third bore is disposed to direct fluid having a third drop weight when ejected from the firing chamber. In so doing, embodiments of the present invention are able to direct the fluid having the third drop weight in a desired direction. Embodiments of the present invention are, however, well suited to forming the second drop ejector such that the second drop weight and the third drop weight are substantially the same. In embodiments of the present invention, the size of the third drop weight generated by the second drop ejector may be determined by the size and/or shape of the third bore.

At step 950 of flowchart 900, a first heating element of the first drop ejector is electrically coupled in series with a second heating element of the second drop ejector and with a voltage source. In embodiments of the present invention, the voltage source is configured such that a first voltage generated by the voltage source activates the first drop ejector separately and a second voltage generated by the voltage source activates the first drop ejector and the second drop ejector substantially concurrently. In so doing, the heating element of the first drop ejector causes fluid having a first drop weight to be ejected from the firing chamber either separately or substantially concurrent to the heating element of the second drop ejector causing fluid having a second drop weight to be ejected from the firing chamber. Additionally, in embodiments of the present invention, a third voltage generated by the voltage source activates the second heating element of the second drop ejector such that fluid having a third drop weight is ejected from the second drop ejector substantially concurrent to the ejecting of the fluid having the first drop weight and the fluid having the second drop weight.

As mentioned above, the present embodiment of the multi-drop weight firing architecture is compatible with existing firing chamber, printhead, and printer component fabrication processes. That is, the present embodiment of the multi-drop weight firing architecture can be manufactured using existing fabrication processes and equipment.

Thus, an embodiment of the present invention provides a firing architecture which is able to efficiently meet the resolution and technological demands of sophisticated printing systems.

The foregoing descriptions of specific embodiments of the present invention have been presented for purposes of illustration and description. They are not intended to be exhaustive or to limit the invention to the precise forms disclosed, and many modifications and variations may be possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A fluid ejection device comprising:

a first drop ejector associated with a firing chamber and comprising a first heating element, said first drop ejector configured to cause fluid having a first drop weight to be ejected from said firing chamber;

a first bore disposed within an orifice layer disposed proximate to said first drop ejector, said first bore associated with said first drop ejector;

a second drop ejector associated with said firing chamber and comprising a second heating element, said second drop ejector configured to cause fluid having a second drop weight to be ejected from said firing chamber;

a second bore disposed within said orifice layer disposed proximate to said second drop ejector, said second bore associated with said second drop ejector; and a voltage supply electrically coupled in series with said first drop ejector and said second drop ejector, said voltage supply configured to generate a first voltage for activating said first drop ejector individually and a second voltage for activating said first drop ejector and said second drop ejector substantially concurrently.

2. The fluid ejection device of claim 1, wherein said first bore is disposed to direct said fluid having said first drop weight when ejected from said firing chamber; and wherein said second bore is disposed to direct said fluid having said second drop weight when ejected from said firing chamber such that said first bore and said second bore direct said fluid having said first drop weight and said fluid having said second drop weight in a desired direction.

3. The fluid ejection device of claim 1, wherein said first drop weight is different from said second drop weight.

4. The fluid ejection device of claim 1, wherein said first heating element comprises a first resistor that is substantially uniform in cross section; and wherein said second heating element comprises a second resistor that is substantially uniform in cross section coupled in parallel with a third resistor that is substantially uniform in cross section.

5. The fluid ejection device of claim 4, wherein said first voltage is split between said second resistor and said third resistor.

6. The fluid ejection device of claim 5, wherein said first voltage is insufficient to cause fluid having said second drop weight to be ejected from said second drop ejector.

7. The fluid ejection device of claim 4, wherein said second heating element is further configured to cause fluid having a third drop weight to be ejected from said firing chamber.

8. The fluid ejection device of claim 7, wherein said first bore is disposed to direct said fluid having said first drop weight when ejected from said firing chamber;

wherein said second bore is disposed to direct said fluid having said second drop weight when ejected from said firing chamber; and a third bore disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

9. The fluid ejection device of claim 8, wherein said first bore, said second bore and said third bore are each a different size.

10. The fluid ejection device of claim 9, wherein said first drop weight, said second drop weight, and said third drop weight are each different.

11. The fluid ejection device of claim 9, wherein said second bore is disposed proximate to said second resistor and said third bore is disposed proximate to said third resistor.

12. The fluid ejection device of claim 11, wherein a third voltage causes said second drop ejector to eject said fluid having said second drop weight and said third drop weight substantially concurrent with said first drop ejector ejecting said fluid having said first fluid weight.

13. A printhead comprising:

a firing chamber from which fluid is ejected;

a first heating element disposed within said firing chamber, said first heating element configured to cause ejection of fluid having a first drop weight from said firing chamber;

a second heating element disposed within said firing chamber, said second heating element configured to cause ejection of fluid having a second drop weight from said firing chamber, a voltage source electrically coupled in series with said first heating element and said second heating element, wherein said voltage source is configured to dynamically initiate said first heating element and said second heating element such that said fluid having said first drop weight is ejectable from said firing chamber at least one of substantially concurrently and separately from said fluid having said second drop weight;

a first bore disposed within an orifice layer disposed proximate said first heating element, said first bore associated with said first heating element; and a second bore disposed within an orifice layer disposed proximate said second heating element, said second bore associated with said second heating element.

14. The printhead of claim 13, wherein said first drop weight is different than said second drop weight.

15. The printhead of claim 13, wherein said first bore is disposed to direct said fluid having said first drop weight when ejected from said firing chamber; and wherein said second bore is disposed to direct said fluid having said second drop weight when ejected from said firing chamber such that said first bore and said second bore direct said fluid having said first drop weight and said fluid having said second drop weight in a desired direction.

16. The printhead of claim 13, wherein said first heating element comprises a first resistor that is substantially uniform in cross section: and wherein said second heating element comprises a second resistor that is substantially uniform in cross section coupled in parallel with a third resistor that is substantially uniform in cross section.

17. The printhead of claim 16, wherein said voltage source generates a lower voltage for initiating said first heating element individually and a higher voltage for initiating said first heating element, said second heating element, and said third heating element substantially concurrently.

18. The printhead of claim 16, wherein said second heating element is configured to cause fluid having a third drop weight to be ejected from said firing chamber.

19. The printhead of claim 18, wherein said first drop weight, said second drop weight, and said third drop weight are each different.

20. The printhead of claim 19, wherein said first bore is disposed to direct said fluid having said first drop weight when ejected from said firing chamber;

wherein said second bore is disposed proximate to said second resistor and directs said fluid having said second drop weight when ejected from said firing chamber; and a third bore is disposed proximate to said third resistor and directs said fluid having said third drop weight when ejected from said firing chamber such that said first bore, said second bore, and said third bore direct said fluid having said first drop weight, said fluid having said second drop weight and said fluid having said third drop weight in a desired direction.

21. The printhead of claim 20, wherein said first bore, said second bore and said third bore arc each a different size.

22. The printhead of claim 21, wherein said second resistor generates a greater amount of electrical resistance than said third resistor.

23. The printhead of claim 22, wherein said voltage supply is configured to generate a first voltage, a second voltage, and a third voltage such that said fluid having said first drop weight is ejectable from said firing chamber at least one of substantially concurrently and separately from said fluid, having said second drop weight and said fluid having said third drop weight.

24. A replaceable printer component comprising:

a substrate;

a firing chamber coupled to said substrate;

means for ejecting fluid disposed within said firing chamber, a first of said means for ejecting configured to cause fluid having a first drop weight to be ejected from said firing chamber, and a second of said means for ejecting configured to cause fluid having a second drop weight to be ejected from said firing chamber;

a first bore disposed within an orifice layer disposed proximate to said first means for ejecting, said first bore associated with said first means for ejecting;

a second bore disposed within said orifice layer disposed proximate to said second means for ejecting, said second bore associated with said second means for ejecting; and means for causing said first of said means for ejecting to be initiated at least one of individually or substantially concurrently with said second of said means for ejecting.

25. The replaceable printer component of claim 24, wherein said means for causing comprises a voltage supply coupled in series with said first means for ejecting and said second means for ejecting and is configured to dynamically vary a supply voltage to said first of said means for ejecting and to said second of said means for ejecting.

26. The replaceable printer component of claim 24, wherein said first drop weight is different from said second drop weight.

27. The replaceable printer component of claim 24, wherein said first bore is disposed to direct said fluid having said first drop weight when ejected from said firing chamber; and wherein said second bore is disposed to direct said fluid having said second drop weight when ejected from said firing chamber such that said first bore and said second bore direct said fluid having said first drop weight and said fluid having said second drop weight in a desired direction.

28. The replaceable printer component of claim 24, wherein said first heating element of said first of said means for ejecting comprises a first resistor that is substantially uniform in cross section; and wherein said second heating element of said second means for ejecting comprises a second resistor that is substantially uniform in cross section coupled in parallel with a third resistor that is substantially uniform in cross section.

29. The replaceable printer component of claim 28, wherein said second of said ejecting means is further configured to cause fluid having a third drop weight to be ejected from said firing chamber.

30. The replaceable printer component of claim 29, wherein said first drop weight, said second drop weight, and said third drop weight are each different.

31. The replaceable printer component of claim 29, wherein said second bore is disposed proximate to said second resistor and directs said fluid having said second drop weight when ejected from said firing chamber; and a third bore is disposed proximate to said third resistor and directs said fluid having said third drop weight when ejected from said firing chamber such that said first bore, said second bore, and said third bore direct said fluid having said first drop weight, said fluid having said second drop weight, and said fluid having said third drop weight in a desired direction.

32. The replaceable printer component of claim 31, wherein said second resistor generates a greater amount of electrical resistance than said third resistor.

33. The replaceable printer component of claim 32, wherein said means for causing is configured to dynamically vary a supply voltage to said first of said means for ejecting and to said second of said means for ejecting such that said fluid having said first drop weight is ejectable from said firing chamber at least one of substantially concurrently and separately from said fluid having said second drop weight and said fluid having said third drop weight.

34. The replaceable printer component of claim 33, wherein said first bore, said second bore and said third bore are each a different size.

35. The replaceable printer component of claim 24 further comprising means for predetermining a size for said fluid having said first drop weight and a size for said fluid having said second drop weight.

36. The replaceable printer component of claim 35, wherein said means for predetermining a size comprises:

selecting an appropriate size for said first heating element; and selecting an appropriate size for said second heating element.

37. The replaceable printer component of claim 36, wherein said means for predetermining comprises:

selecting at least one of a first bore size and a first bore shape for said first bore; and selecting at least one of a second bore size and a second bore shape for said second bore.

38. A method of manufacturing a fluid ejection device comprising:

forming a first drop ejector to be associated with a firing chamber, said first drop ejector for causing fluid having a first drop weight to be ejected from said firing chamber;

forming a second drop ejector to be associated with said firing chamber, said second drop ejector for causing fluid having a second drop weight to be ejected from said firing chamber, forming a first bore associated with said first drop ejector;

forming a second bore associated said second drop ejector; and electrically coupling a first heating element of said first drop ejector in series with a second heating element of said second drop ejector and with a voltage source configured to dynamically initiate said first drop ejector and said second drop ejector such that said fluid having said first drop weight is ejectable from said firing chamber at least one of substantially concurrently and separately from said fluid having said second drop weight.

39. The method of manufacturing a fluid ejection device as recited in claim 38, comprising forming said first fluid ejector and forming said second fluid ejector such that said first drop weight is different than said second drop weight.

40. The method of manufacturing a fluid ejection device as recited in claim 38, further comprising:

forming said first bore oriented to direct said fluid having said first drop weight when ejected from said firing chamber;

forming said second bore oriented to direct said fluid having said second drop weight when ejected from said firing chamber such that said first bore and said second bore direct said fluid having said first drop weight and said fluid having said second drop weight in a desired direction.

41. The method of manufacturing a fluid ejection device as recited in claim 38, further comprising;

forming said first heating element using a first resistor that is substantially uniform in cross section; and forming said second heating element using a second resistor that is substantially uniform in cross section coupled in parallel with a third resistor that is substantially uniform in cross section.

42. The method of manufacturing a fluid ejection device as recited in claim 41, further comprising:

forming said second drop ejector such that said second drop ejector causes fluid having a third drop weight to be ejected from said firing chamber.

43. The method of manufacturing a fluid ejection device as recited in claim 42, wherein said first drop weight, said second drop weight, and said third drop weight are each different.

44. The method of manufacturing a fluid ejection device as recited in claim 43, further comprising:

forming said first bore proximate to said first heating element of said first drop ejector, said first bore disposed to direct said fluid having said first drop weight when ejected from said firing chamber;

forming said second bore proximate to said second resistor of said second heating element, said second bore disposed to direct said fluid having said second drop weight when ejected from said firing chamber; and forming a third bore proximate to said third resistor of said second heating element, said third bore disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

45. The method of manufacturing a fluid ejection device as recited in claim 44, comprising forming said second heating element wherein said second resistor has a greater resistance than said third resistor.

46. The method of manufacturing a fluid ejection device as recited in claim 45, comprising said voltage supply dynamically activating said first drop ejector and said second drop ejector such that said fluid having said first drop weight is ejectable from said firing chamber at least one of substantially concurrently and separately from said fluid having said second drop weight and said fluid having said third drop weight.

* * * * *